US007832721B2

(12) United States Patent
Kutzer et al.

(10) Patent No.: US 7,832,721 B2
(45) Date of Patent: Nov. 16, 2010

(54) METHOD AND APPARATUS FOR SEPARATING OBJECTS

(75) Inventors: Oliver Kutzer, Radolfzell (DE); Hauke Lübben, Radolfzell (DE); Michael Schwarzbauer, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 59 days.

(21) Appl. No.: 12/396,028

(22) Filed: Mar. 2, 2009

(65) Prior Publication Data

US 2009/0218751 A1 Sep. 3, 2009

(30) Foreign Application Priority Data

Feb. 28, 2008 (DE) ..... 10 2008 011 651
Mar. 18, 2008 (DE) ..... 10 2008 014 676

(51) Int. Cl.
*B65H 3/52* (2006.01)

(52) U.S. Cl. ..... 271/121; 271/10.01; 271/10.08; 271/104; 271/124; 271/125; 271/134; 271/137

(58) Field of Classification Search ..... 271/10.01, 271/10.08, 104, 121, 124, 125, 134, 137
See application file for complete search history.

(56) References Cited

U.S. PATENT DOCUMENTS 3,825,251 A * 7/1974 Beery et al. ..... 271/258.03
3,961,786 A 6/1976 Yanker
3,981,493 A 9/1976 Klappenecker et al.
4,050,690 A * 9/1977 Michelson ..... 271/125
4,451,027 A 5/1984 Alper
4,607,833 A 8/1986 Svyatsky et al.
6,123,330 A 9/2000 Schaal
6,231,041 B1 * 5/2001 Jacques ..... 271/121
7,168,696 B2 1/2007 Zattler
7,270,326 B2 * 9/2007 Mitsuya et al. ..... 271/265.04
7,293,769 B2 * 11/2007 Asari et al. ..... 271/258.01
2005/0046102 A1 * 3/2005 Asari et al. ..... 271/10.01
2006/0017216 A1 * 1/2006 Mitsuya et al. ..... 271/121
2009/0189332 A1 7/2009 Schwarzbauer et al.

FOREIGN PATENT DOCUMENTS

DE 1 611 378 12/1970
DE 195 45 057 C1 8/1996
DE 102 12 024 A1 10/2003
DE 10 2004 037 422 B3 3/2006

* cited by examiner

*Primary Examiner*—Patrick Mackey
*Assistant Examiner*—Prasad V Gokhale
(74) *Attorney, Agent, or Firm*—Laurence A. Greenberg; Werner H. Stemer; Ralph E. Locher

(57) ABSTRACT

A method for separating objects from a stack in a stream of objects, in which the objects are removed from the stack with a removal device, and overlapping objects are separated from one another with a separating device. To achieve reliable separation with a low double removal rate, a plurality of traction devices grip both sides of the removed object and are driven in the transport direction at different forward driving speeds.

14 Claims, 6 Drawing Sheets

METHOD AND APPARATUS FOR SEPARATING OBJECTS

CROSS-REFERENCE TO RELATED APPLICATION

This application claims the priority, under 35 U.S.C. §119, of German patent application DE 10 2008 011 651.3, filed Feb. 28, 2008, and German application DE 10 2008 014 676.5, filed Mar. 18, 2008; the prior applications are herewith incorporated by reference in their entirety.

BACKGROUND OF THE INVENTION

Field of the Invention

The invention relates to a method for separating objects from a stack in a stream of objects, in which the objects are removed from the stack with a removal device, and overlapping objects are separated from one another with a separating device, and a plurality of traction devices grip both sides of the object so removed and are driven in the transport direction at different forward driving speeds. Traction devices which grip the front of the object in the transport direction are driven at a faster forward driving speed than traction devices which grip further back on the object.

In addition, the invention relates to an apparatus for separating objects from a stack in a stream of objects having a removal device for removing the objects from the stack, a separating device for separating overlapping objects from one another, and a process device for controlling the separation, the separating device having a plurality of traction devices on both sides of an object located in the separating device for jointly gripping the object, and the traction devices being driveable in the transport direction at different forward driving speeds, and the process device being designed to drive traction devices which grip the front of the object in the transport direction at a faster forward driving speed than traction devices which grip further back on the object.

Flat objects, such as letters, large letters, postcards, wrapped periodicals and the like, are sorted in very large numbers in sorting offices or large post offices by their address and deposited in a multitude of stacking compartments. For sorting, the flat objects are first stacked and then separated from the stack and introduced into a stream of objects in which the objects are spaced apart from one another and can be steered independently of one another.

An apparatus for separating flat objects is disclosed in our commonly assigned German patent DE 10 2004 037 422 B3. The objects to be separated are accelerated by a plurality of belts, the speed of which can be controlled independently, and fed to a transport path. In order to prevent double removals, retaining elements are arranged opposite the belt, by means of which double removed objects are held back.

In order to reliably hold back double removals, it is known from U.S. Pat. Nos. 4,451,027 and 3,961,786 to drive a retaining element against the transport direction so that a double removed mailing is reliably held or driven back.

SUMMARY OF THE INVENTION

It is accordingly an object of the invention to provide a method and an apparatus for separating objects which overcomes the above-mentioned disadvantages of the heretofore-known devices and methods of this general type and which allows the objects to be separated quickly and reliably and with a low double removal rate.

With the foregoing and other objects in view there is provided, in accordance with the invention, a method for separating objects from a stack into a stream of objects, which comprises the following steps:

- removing objects from the stack with a removal device;
- separating overlapping objects from one another with a separating device;
- gripping both sides of a removed object with a plurality of traction devices including forward traction devices gripping a forward part of the object and rearward traction devices gripping the object further back; and
- driving the traction devices in a transport direction at defined forward driving speeds, and thereby:
  - driving the forward traction devices at a faster forward driving speed than the traction devices; and
  - driving the traction devices on one side of the object at a higher forward driving speed than the respective traction devices on the opposite side.

In other words, the objects relating to the method are achieved by a method of the kind mentioned in the introduction in which, according to the invention, the traction devices on one side of the object are each driven at a higher forward driving speed than the respective opposing traction devices. A double removed object therefore does not have to be retained by static retaining elements, but can be retained by driven traction devices which, for example, initiate a slower forward drive, a stopping or a reverse drive of the double removed object. Double removed objects can be controlled and very efficiently and reliably held back by this means. When the traction devices on both sides of the removed object are each driven at different forward driving speeds—the traction devices on each side of the object are consequently driven at a different forward driving speed at the same time—it is also possible to control a holding back depending on the position of the object in the separating device.

The overlapping objects can be separated by the separating device during or after removal of the objects by the removal device. The traction devices are preferably driven by a process device at a different forward driving speed, wherein advantageously all traction devices are driven individually, the traction devices therefore being able to be addressed individually by the process device. Advantageously, the traction devices are each arranged opposite the object in pairs and serve to transport the object in the transport direction. "Opposite" and "on both sides of the removed object" can be understood to mean that the traction devices are arranged on both flat sides of the object for example, the object therefore being located between the traction devices. The objects run through the separating device on a transport path, wherein the traction devices are arranged on both sides of the transport path and as a result are able to grip the object from both sides in the transport path.

The objects can be postal items of all kinds, in particular postal items such as letters, large letters, flats, periodicals, catalogues, books, packages or parcels. In particular, the objects are flat objects, the thickness of which does not exceed 20%, preferably 10%, of their height. The height refers to an object standing on a longitudinal edge. The removal device expediently has a removal element for pulling an object to be removed, which exerts a force on the object in the removal direction and thus removes it. A stream of objects comprises a plurality of objects transported one after the other and each standing on their longitudinal edge.

In an advantageous embodiment of the invention, the traction devices are each arranged opposite the object in pairs. Two traction devices in each case can therefore exert a force and a counter force on the object and transport it at a defined speed. Expediently, all traction devices are in each case arranged in pairs. When arranged in pairs, two identical traction devices are advantageously arranged opposite one another, in particular with an exactly opposite contact surface which grips the object.

A fine grading of speeds or accelerations of the object can be achieved when the traction devices have rollers for contacting the objects. Belts can be dispensed with and a contact line or contact surface of the rollers on an object can be kept small.

A further advantageous embodiment of the invention provides that those traction devices which grip the front of the object in the transport direction, e.g. are arranged at the front of the transport device in the transport direction, are driven at a faster transport speed than those traction devices which grip further back on the object, that is to say are arranged further back in the transport device. This enables the object to be held taut. Overlapping and offset objects can also be separated from one another. This can be achieved, as an object which is located further back is relatively retained as the forward driving speed of the traction devices in the transport path increases. With regard to the transport movement of an object, it is separated from the stack at the front and back and can be seen in the stream of objects.

Expediently, the transport speed in the transport device is divided into several different, preferably at least four different forward driving speeds. At the same time, the traction devices can each have one or more traction elements, e.g. rollers.

A particularly finely graded increase in speed and a fine local resolution of a speed determination of an object can be achieved when the transport speed increases from traction device to traction device in the transport path. The increase here is understood to be in the transport direction, that is to say generally from back to front.

The speed of an object in the separating device can be reliably measured when those traction devices which grip the front of the object in the transport direction grip the object with a higher frictional torque than those traction devices which grip further back on the object. By this means, the objects are gripped most strongly at the front and are pulled by the separating device. An increasing frictional torque can be realized by an increasing pressure with which the traction devices press against the object.

Advantageously, the frictional torque increases in several different, preferably at least four different torque steps in the transport path, expediently from traction device to traction device.

Objects can be transported with a defined transport speed at different forward driving speeds of the traction devices when traction devices which grip the object freewheel and are pulled by the object. A pair of traction devices which grips the front of the object and runs at the highest speed can therefore determine the transport speed of the object, and pairs of transport devices which are arranged further back and are driven more slowly can freewheel and thus hold back the object with only a small force so that the foremost pair of traction devices does not slip or only slips very slightly on the object.

Here, at least all those traction devices which are located after a foremost traction device at a particular time can freewheel, wherein they run synchronously with the object, which is transported faster than their forward driving speed. To increase a driving frictional torque, two consecutive traction devices can be driven at the same speed, so that several subsequent traction devices can also freewheel and be pulled without the object slipping on the two foremost traction devices.

Advantageously, traction devices which grip the object and are freewheeling exert a smaller force on the object than they exert on the object when they are driving. This enables a traction device or a pair of traction devices to exert a high force on the object when applying a forward drive, and subsequently—when the object is transported even faster by a traction device further forward—to lag slightly with a lower force without holding the object back significantly.

Forward drive can be switched off for freewheeling traction devices. However, this requires a certain control complexity. This can be avoided when traction devices which grip the object and are freewheeling continue to be driven at a forward driving speed. Driving at the slower forward driving speed does not affect pulling while freewheeling faster, enabling disruption of the control of the forward drive to be dispensed with. Freewheeling can therefore be used at the same time as forward drive when the gripped object runs faster—that is to say the running speed is higher—than the forward drive.

If the traction devices on one side of the object are each driven at a higher forward drive speed than the respective opposing traction devices, then a shear force is exerted on the object. This results in two overlapping objects being pushed along one another and separated.

When separating postal items, it can come about that two or more postal items become entangled with one another when separating and cannot be separated by means of a shear force in one direction. If the speed difference can be switched over so that traction devices that were previously driven faster are now driven slower than the respective opposing traction devices, then an entanglement can be released and previously entangled postal items can still be separated.

An advantageous development of the invention provides that speed sensors are available which measure the running speed of the traction devices. Based on the running speed, it is possible to determine how quickly an object is transported through the separating device. The location of an object in the separating device can be determined by a locally resolved measurement of the speed from traction device to traction device. Such a speed measurement also enables two overlapping objects in the separating device to be detected. The running speed of the traction device is its instantaneous speed of movement or rotational speed. The speed sensors which are provided for measuring the speed of the traction devices can be part of the traction devices, for example servo motors whose speed is sampled, or separate from the traction devices.

If a leading edge and a trailing edge of an object in the separating device are detected with the help of a sensor, in particular an optical sensor, then its length can be determined. If the detected length increases, then it can be concluded that two objects which are initially recorded as one object are pushed together. This enables the presence of two overlapping objects in the separating device to be detected. The sensor can be a row of sensors with a plurality of sensor elements arranged along the transport path. The sensor can be operated with electromagnetic radiation in the visible or invisible range or with ultrasound, or work in a different manner, e.g. capacitively or by scanning.

Furthermore, it is proposed that a transport speed of an object in the separating device be determined with the help of the optical sensor. This enables an actual speed of the object to be detected with high reliability.

Slip of an object against a traction device can be detected when a speed of the object determined by means of the optical sensor is compared with the running speed of the traction devices.

In a further variation of the invention, it is proposed that the length of an object which is located in the separating device, or even before it, be measured. This enables the number of traction devices that are gripping or which will grip the object and what forces will be applied to it to be determined. The number of traction devices which are expedient to grip the object to transport it at the speed of the gripping traction device without the object slipping along the traction device can also be determined.

Advantageously, an object is divided into at least one front and one rear area, and traction devices on one side are switched to a retaining mode as soon as the rear area has reached a designated position in the separating device. This enables a stripping force for stripping off an overlapping object to be increased on the object when the object to be transported has been adequately gripped by the separating device and will therefore be reliably transported further.

Switching over to a retaining mode can take place by braking or reversing traction devices on one side relative to the respective opposing traction devices.

Advantageously, the division into the front and rear area is carried out depending on a characteristic of the object. This enables a reliable gripping of the object to be made dependent on its length, thickness, speed or some other variable.

Expediently, before switching over to the retaining mode, a check is carried out as to whether the object has already been reliably gripped by one or more traction devices which are not intended for switching to the retaining mode. For example, this can be done by detecting an acceleration of the object and making a switchover to the retaining mode dependent on the acceleration of the object. The object can thus be divided into a front, central and rear area for example, and a traction device which is arranged in the central area can be switched over for holding back. If no deceleration or little deceleration of the object is produced by this holding back, the and/or further traction devices can be switched to retaining mode.

With the above and other objects in view there is also provided, in accordance with the invention, an apparatus for separating objects from a stack in a stream of objects, comprising:

- a removal device for removing the objects from the stack;
- a separating device for separating overlapping objects from one another; and
- a process device connected to said separating device for controlling the separation;
- said separating device having a plurality of traction devices on both sides of an object located in said separating device for jointly gripping the object, and said traction devices being driveable in the transport direction at mutually different forward driving speeds;
- said process device being configured to drive traction devices that grip a front of the object in the transport direction at a faster forward driving speed than traction devices which grip further back on the object; and
- said process device being configured to drive said traction devices on one side of the object at a greater forward driving speed than the respective opposing traction devices in each case.

In other words, the objects relating to the apparatus are achieved by an apparatus of the kind mentioned in the introduction in which, according to the invention, the process device is designed to drive the traction device on one side of the object at a higher forward driving speed than the respective opposing traction devices in each case. Expediently, the forward driving speed is controlled by the process device which is provided for driving each of the traction devices at different forward driving speeds.

Advantageously, the traction devices each incorporate their own drive and can be driven individually by the process device.

Advantageously, the traction devices comprise servo motors which, on the one hand, are provided for applying the forward driving speed to the traction devices, and their running speed can be picked off, enabling the running speed of the individual traction devices to be measured. Advantageously, the running speed can also be measured when the running speed is higher than the forward driving speed. Other features which are considered as characteristic for the invention are set forth in the appended claims.

Although the invention is illustrated and described herein as embodied in a method and apparatus for separating objects, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
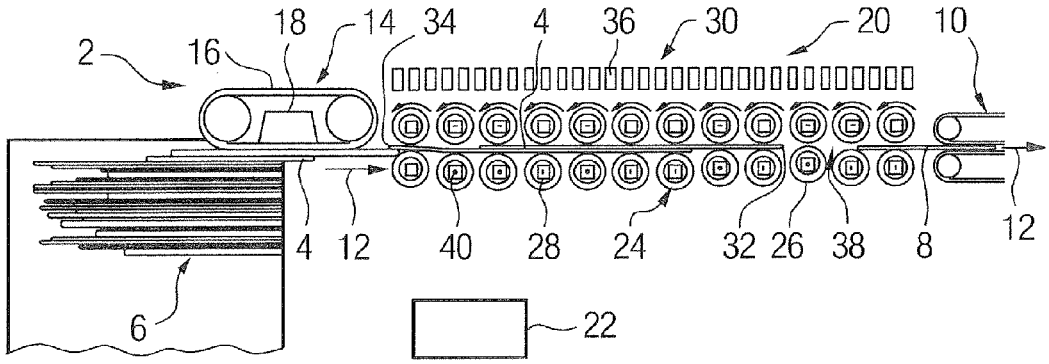
FIG. 1 shows an apparatus for separating postal items having a separating device, which comprises 24 traction devices and a row of sensors.

Referring now to the figures of the drawing in detail and first, particularly, to FIG. 1 thereof, there is shown an exemplary apparatus 2 for separating objects 4 from a stack 6 in a stream of items 8 which is transported onwards in the transport direction 12 by an ongoing transport strand 10. The objects are flat postal items, in particular letters, large letters, flats and periodicals. The process of separating as used here may also be referred to as singling.

The apparatus 2 comprises a removal device 14 with a circulating belt 16 and a suction system 18 for holding the objects 4 to the belt 16 by suction. The currently attached object is transported by the belt 16 in the transport direction 12 to a separating device 20 of the apparatus 2, which—like the removal device 14—is controlled by a process device 22.

The process device 22 can comprise an electronic data processing system, and is prepared for carrying out individual or all of the described method steps by means of one or more appropriate data processing programs.

The separating device 20 comprises 24 traction devices 24, which are each arranged opposite one another in pairs and each have a roller 26 for directly contacting an object located in the separating device 20. The traction devices 24 are each driven by a servomotor, which can be used as a speed sensor 28 and its measuring signal read out by the process device 22.

The separating device 20 also comprises a sensor 30 for detecting a leading edge 32 and a trailing edge 34 of an object 4 located in the separating device 20. The sensor 30 is made up of a plurality of sensor elements 36, which are arranged along a transport path 38 through the separating device 20. Here, the optical sensor elements 36 are positioned relative to the traction devices 24 so that their measuring beam is directed past the traction devices 24, for example by being arranged above or below them.

The separating device 20 can also comprise sensors 40 for measuring a displacement of the traction devices 24 from a rest position, enabling a thickness of the objects 4 to be estimated from the displacement of the traction devices 24 from their rest position. Here, for example, the 12 traction devices 24 shown at the top in FIG. 1 are fixed in their position, and the 12 traction devices 24 shown at the bottom can be displaced perpendicular to the transport direction 12, enabling them to be pushed to the side by the objects 4. It is also conceivable that all traction devices 24 can be displaced and provided with sensors 40, for example.

The 24 traction devices 24 are arranged in such a way that half of the traction devices 24 are arranged on one side of the transport path 38 and the other half of the traction devices 24 are arranged on the other side of the transport path 38. Therefore—as shown in FIG. 1—twelve traction devices 24 are arranged on each side of a removed object 4, of which several grip each side of the object 4 at all times. Two traction devices 24 are arranged exactly opposite one another in each case so that the connection of their axis of rotation is aligned at right angles to the transport direction 12. At the same time, the two traction devices 24 of each pair of traction devices are designed identically with regard to their shape so that they each contact the object 4 clamped between them with an identical contact surface.

Figure 2:
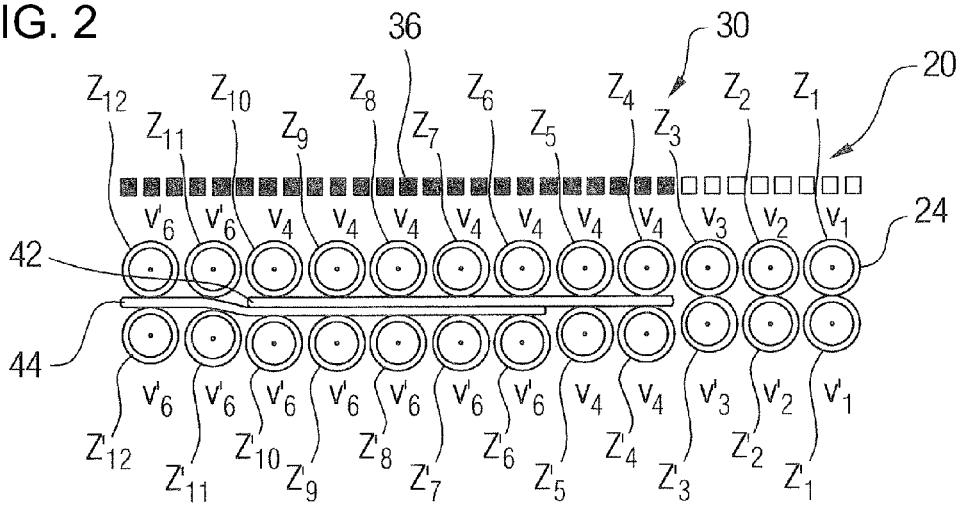
FIG. 2 shows a functional diagram of the separating device with two overlapping postal items.

FIG. 2 shows the separating device 20 in a functional manner. The sensor elements 36 show which of the sensor elements 36 have their measuring beam broken by at least one of the objects 4 embodied in the form of postal items 42, 44. The traction devices 24 are differentiated individually by the references $Z_1$-$Z_{12}$ and $Z'_1$-$Z'_{12}$.

The traction devices $Z_1$-$Z'_{12}$ are controlled by the process device 22 so that the foremost top traction device $Z_1$ is driven at the forward driving speed $v_1$, the following traction device $Z_2$ at the forward driving speed $v_2$, the third traction device $Z_3$ at the forward driving speed $v_3$ etc. until the last traction device $Z_{12}$, which is driven at the forward driving speed $v_{12}$. The traction devices $Z'_1$-$Z'_{12}$ in the bottom row are driven in a similar manner, namely the foremost traction device $Z'_1$ at the forward driving speed $v'_1$ etc. until the last traction device $Z'_{12}$ at the forward driving speed $v'_{12}$. The relationship between the magnitudes of the forward driving speeds $v_1$ to $v'_{12}$ is as follows:

$$v_1>v_2>v_3>\ldots>v_{12},$$

$$v'_1>v'_2>v'_3>\ldots>v'_{12},$$

$$v_1>v'_1,\ v_2>v'_2,\ \ldots,\ v_{12}>v'_{12}.$$

In addition, the bottom traction devices $Z'_1$-$Z'_{12}$ are pressed in the direction of the postal items 42, 44 with different spring pressure so that the frictional torque of the postal items 42, 44 between the first, foremost pair of traction devices $Z_1$, $Z'_1$ is greater than the frictional torque of the postal items 42, 44 between the next pair of traction devices $Z_2$, $Z'_2$ behind them, etc. until the last pair of traction devices $Z_{12}$, $Z'_{12}$, between which the postal items 42, 44 are guided with the least frictional torque.

In the position of the postal items 42, 44 shown in FIG. 2, the first three traction devices $Z_1$-$Z'_3$ are in each case not in contact with the postal items 42, 44, and the foremost area of the front postal item 42 is clamped between the traction devices $Z_4$, $Z'_4$. This pair of traction devices determines the transport speed of the postal item 42 in the separating device 20, which is the forward driving speed $v_4$. Although the traction device $Z'_4$ is only driven with the somewhat lower forward driving speed $v'_4$, it is pulled along at the forward driving speed $v_4$, which the traction device $Z_4$ applies to the postal item 42. The traction device $Z'_4$ therefore freewheels, as it is pulled along faster than its forward driving speed $v'_4$.

As a result, a small shear force is imposed on the postal item 42 by the traction device $Z'_4$, which pushes the underside of the postal item 42 slightly backwards. However, this shear force is small, as the freewheeling resistance of the traction device $Z'_4$ is considerably less than the frictional torque with which it would effect a forward drive of the postal item 42. Traction devices $Z_5$ and $Z'_5$ are pulled along in the same way, so that they too freewheel at the running speed $v_4$.

With the next pair of traction devices $Z_6$, $Z'_6$, the top traction device $Z_6$ is likewise pulled along at the forward driving speed $v_4$ of the fourth traction device $Z_4$ and runs synchronously with it. The opposing traction device $Z'_6$ runs slower, however, as all freewheeling traction devices $Z'_4$-$Z'_{12}$ exert a holding-back force on the bottom postal item 44 and brake it. The speed with which the postal item 44 is transported in the transport direction 12 is therefore the forward driving speed $v'_6$ of the traction device $Z'_6$, which pulls the postal item 44 forwards. The traction devices $Z'_7$-$Z'_{12}$, which are arranged further upstream, in turn freewheel at the forward driving speed $v'_6$, which for them is the running speed.

With these traction devices $Z'_7$-$Z'_{12}$, the forward driving speed $v'_7$ to $v'_{12}$ therefore differs from the instantaneously applied freewheeling speed $v'_6$. The instantaneously applied forward driving speed or freewheeling speed of all traction devices $Z_1$-$Z'_{12}$ in each case is measured in the appropriate speed sensors 28 of the separating device 20 or the traction devices $Z_1$-$Z'_{12}$ and is registered by the process device 22.

As a result of the different speeds of the traction devices $Z_1$ to $Z'_{12}$, the process device 22 registers that a first postal item 42 is present on the top traction devices $Z_4$-$Z_{10}$ and a second postal item 44 on the bottom traction devices $Z'_6$ to $Z'_{12}$. As the postal items 42, 44 are overlapping, the process device 22 registers that one of the postal items 42, 44 must be held back in order to separate them from one another. As that of the postal items 42, 44 to be held back is expediently the postal item 44 which is located further back, the process device 22 causes the traction devices $Z'_6$-$Z'_{12}$ to stop.

Figure 3:
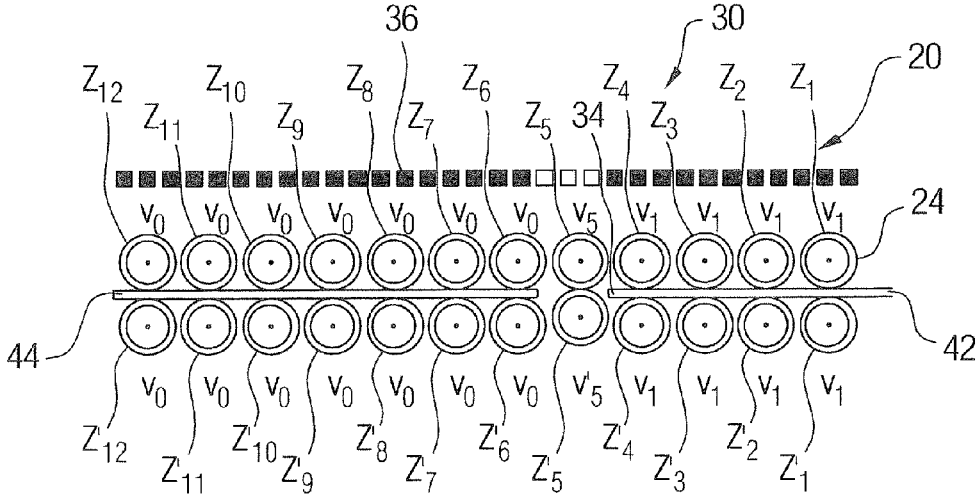
FIG. 3 shows the functional diagram with the two postal items separated from one another.

This situation is shown in FIG. 3. By stopping the traction devices $Z'_6$-$Z'_{12}$, the rear postal item 44 remains stationary in the separating device 20, whereas the front postal item 42 continues to be driven. In this case, in its further progress through the separating device 20, this postal item 42 first accelerates to the forward driving speed $v_3$, then to the forward driving speed $v_2$ and finally to the fastest forward driving speed $v_1$, wherein in each case the subsequent traction devices $Z_4$-$Z_9$, $Z_3$-$Z_8$, $Z_2$-$Z_7$ are pulled along and freewheel at the respective running speed $v_3$, $v_2$, $v_1$.

Here, however, the forward driving speed of the top traction devices $Z_6$-$Z_{12}$ is likewise set to zero so that the rear postal item 44 remains held in its position. The front postal item 42 is transported away forwards. In doing so, at some point a gap is produced between these two postal items 42, 44 which is detected by at least one of the sensor elements 36 as shown in FIG. 3.

When it is determined that the speeds of all the traction devices $Z_1$-$Z'_4$ over the front postal item 42 are identical, then the postal item 42 is categorized by the process device 22 as being reliably separated and is transported away. The following postal item 44 can immediately be started for onward transportation. However, the gap between the postal items 42, 44 must reach a minimum size. The process device 22 measures the length of the gap with the help of the sensor elements 36. If the trailing edge 34 is sufficiently far forward and the gap is sufficiently large, then the traction devices $Z_6$ to $Z'_{12}$ are driven and the rear postal item 44 is transported in the transport direction 12 at increasing transport speed and constant shear forces between the top and bottom of the postal item 44.

It is likewise possible to move the second postal item 44 immediately at the same speed, that is to say $v_1$, combined with the shear forces associated with freewheeling. In this way, a high throughput can be achieved through the separating device 20. The throughput can be further increased if the resulting gap between the postal items 42, 44 is reduced to a minimum gap. This can be done by transporting the rear postal item 44 at a speed v which is higher than the speed $v_1$ at which the front postal item 42 is transported away until the gap has increased to the minimum size. The size of the gap is monitored by the sensor 30.

Figure 4:
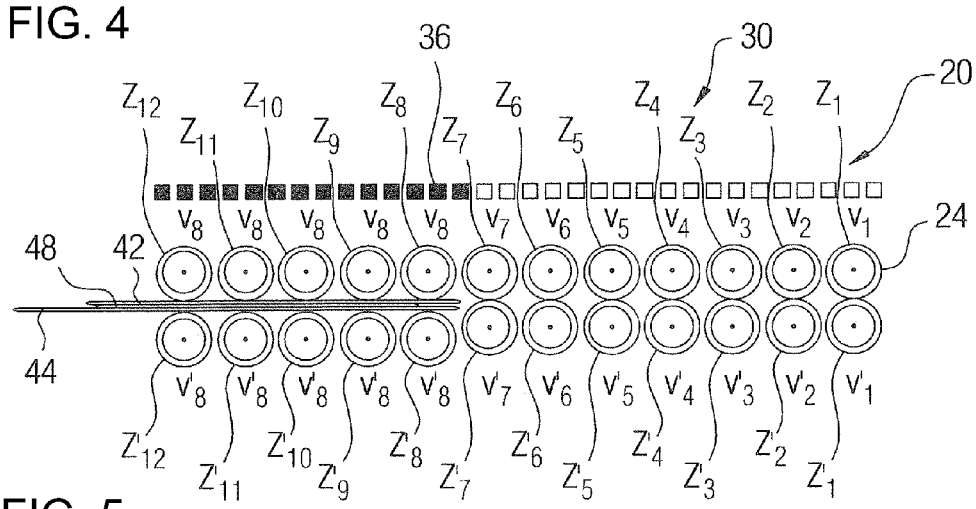
FIGS. 4 to 6 shows a process for separating three overlapping postal items.
Figure 5:
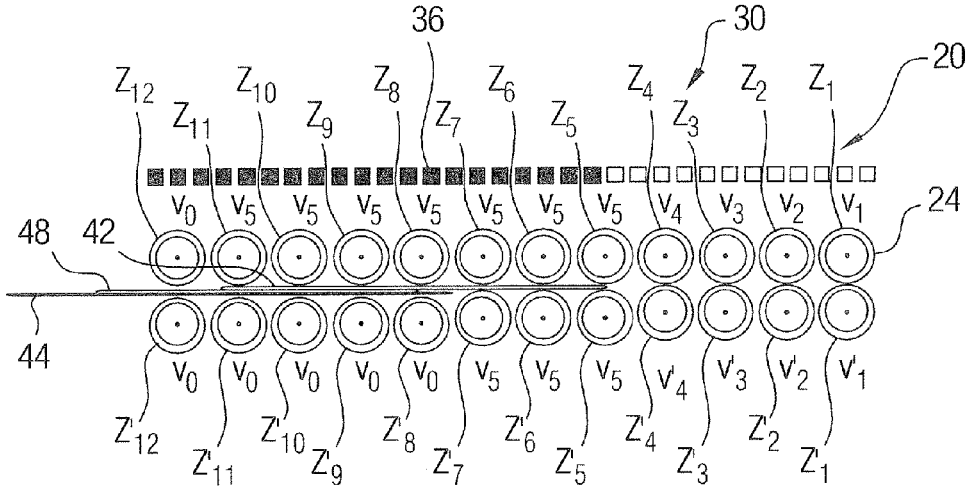

In the exemplary embodiment shown in FIG. 4, a further postal item 48 is clamped completely invisibly from the outside between the postal items 42, 44. Because of the different running speeds $v_8$, $v'_8$ of the traction devices $Z_9$-$Z'_{12}$, the process device 22 initially registers that there must be at least two postal items 42, 44 which are located in an overlapping manner in the separating device 20. The traction devices $Z'_8$ to $Z'_{12}$ are accordingly stopped as shown in FIG. 5. The top traction devices $Z_1$ to $Z_{12}$ initially run at the forward driving speed $v_1$ to $v_{12}$ or at the correspondingly higher running speed, at the point in time shown in FIG. 5 at the running speed $v_5$.

As shown in FIG. 5, the last of the top traction devices $Z_{12}$ loses contact with the top postal item 42. It is therefore no longer pulled along and slows down from the running speed $v_5$ to its forward driving speed $v_{12}$. This is detected by the process device 22 which thereupon stops the traction device $Z_{12}$. As a result, no forward drive acts from above on the postal item 44 or 48 and crumpling of the respective postal items 44, 48 is avoided. Depending on the progress of the postal item 42 in the transport device 20, the traction devices $Z_{11}$, $Z_{10}$, $Z_9$ etc. are successively stopped.

Figure 6:
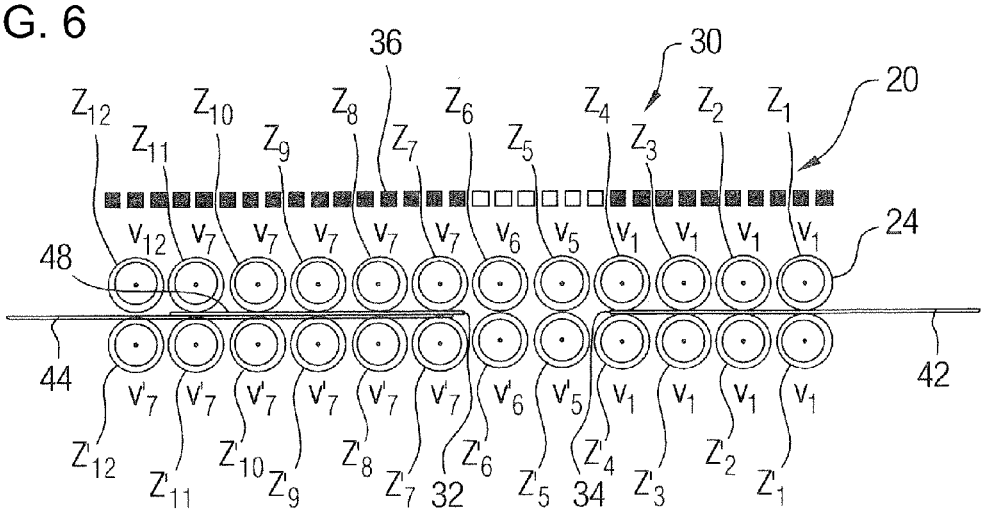

Finally, a gap is detected between the postal items 42, 44 as shown in FIG. 6. If the gap between the postal items 42, 44 is sufficiently large and the trailing edge 34 is sufficiently far forward, then the postal item 44 is transported onwards. However, because the dashed forward driving speeds of the bottom traction devices $Z_8$-$Z_{12}$ are less than the un-dashed forward driving speeds of the top traction devices $Z_8$-$Z_{12}$, a shear force is applied to the two postal items 44, 48. As a result, the top postal item 48 is transported forwards faster than the bottom postal item 44.

From this, based on the measuring results, the process device 22 can determine that there are two postal items 44, 48 in the separating device 20. Initially the two postal items 44, 48 move through the separating device 20 at different speeds as described for FIG. 2. In addition, the leading edge 32 of the postal item 48 finally moves forward faster than the trailing edge of the postal item 44. As a result, an increasing number of sensor elements 36 are covered, which would be impossible in the case of a single postal item 44. For this reason too, the process device 22 detects the presence of two overlapping postal items 44, 48 in the separating device 20.

Thirdly, there is the possibility of determining the speed of the trailing edge 34 with the help of the sensor elements 36 and comparing this with the fastest forward driving speed. If the speed of the trailing edge 34 is less than the fastest forward driving speed, there must be two different overlapping postal items 44, 48.

Fourthly, the process device 22 detects that, at a position of the postal items 44, 48 as shown in FIG. 6, the last top traction device $Z_{12}$ is no longer being pulled along at the running speed $v_7$, whereas the last bottom traction device $Z'_{12}$ is indeed still being pulled along at the running speed $v'_7$. This is only possible with two overlapping postal items 44, 48. An overlapping of postal items 44, 48 can therefore also be detected by monitoring the running speeds.

The process device 22 now behaves as described for FIG. 2 and FIG. 3 and separates the two postal items 44, 48 from one another and guides them individually to the transport strand 10.

Figure 7:
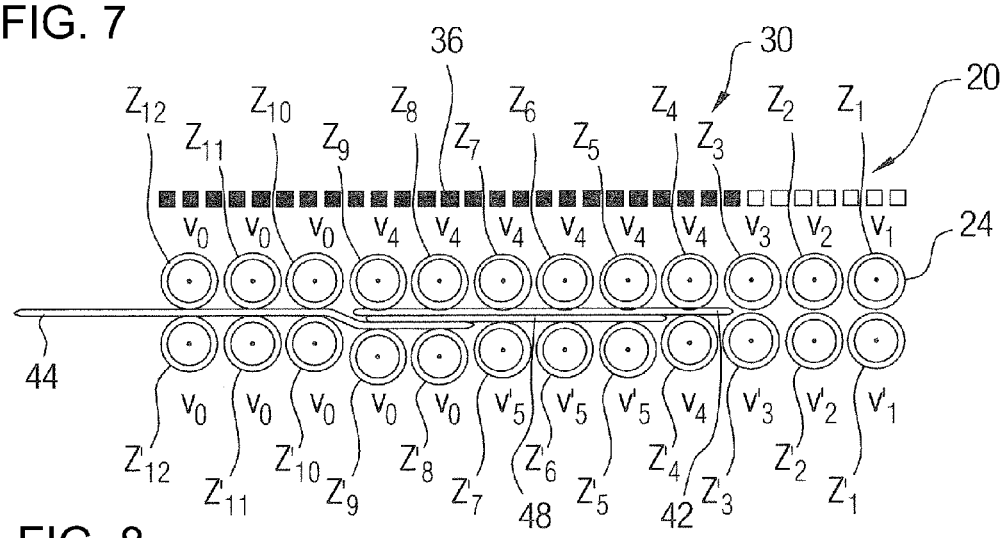
FIG. 7 shows the separation of three postal items attached to one another in a different way.

In the example shown in FIG. 7, the middle postal item 48 sticks to the top, front postal item 42 and is transported along with it. As shown in FIG. 7, the rearmost postal item 44 is stopped as described for FIG. 5, and the two other postal items 42, 48 are transported forwards. As the traction devices $Z'_5$-$Z'_8$ hold back the bottom postal item 48, it is transported at a lower forward driving speed $v'_5$ than the top postal item 42 which is transported at the forward driving speed $v_4$. As a result of this, on the one hand, the process device 22 detects that there are two separate postal items 42, 48 and, on the other, that the top postal item has already reached the fourth pair of traction devices $Z_4$, $Z'_4$ and the hidden bottom postal item 48 has only reached the fifth traction device $Z'_5$.

The process device 22 now also causes the bottom traction devices $Z'_5$-$Z'_7$ to stop so that the bottom postal item 48 is also stopped. When the postal item 42 has been transported away, the six traction devices $Z_5$-$Z'_7$ are driven at their corresponding forward driving speeds $v_5$-$v'_7$ and, as a result, the postal item 48 alone is transported further forwards, acted upon by a shear force, in order to identify any further undetected postal items.

Figure 8:
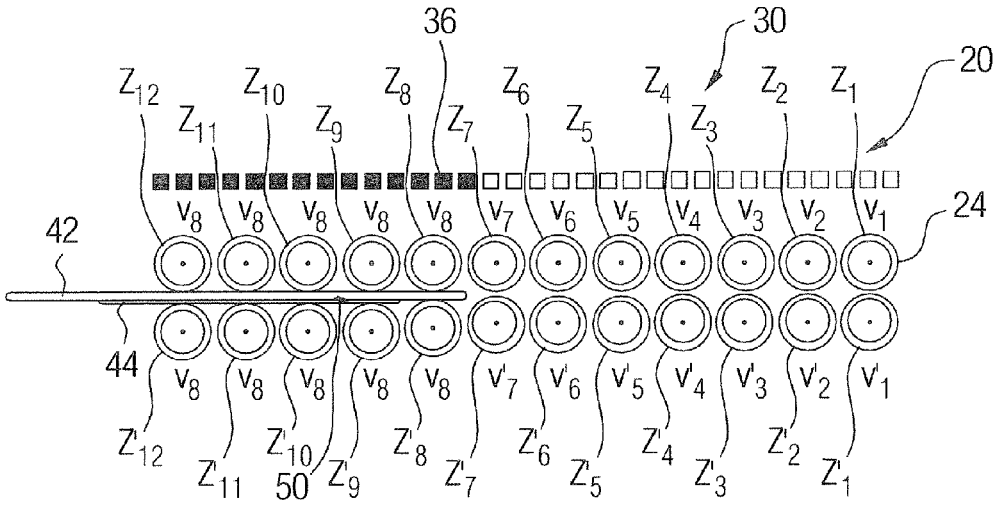
FIG. 8 to 11 shows the separation of two postal items that are entangled.

It is particularly difficult to separate postal items 42, 44 when they are physically entangled with one another. Such an example is shown in FIGS. 8-11. The two postal items 42, 44 are initially transported into the separating device 20 without it being possible to detect the presence of two separate postal items 42, 44 as shown in FIG. 8. Although the bottom traction devices $Z'_9$-$Z'_{12}$ exert a holding-back torque on the bottom postal item 44 so that this would only have to be transported at the forward driving speed $v'_9$, an entanglement 50 prevents the postal item 44 moving backwards relative to the postal item 42.

Figure 9:
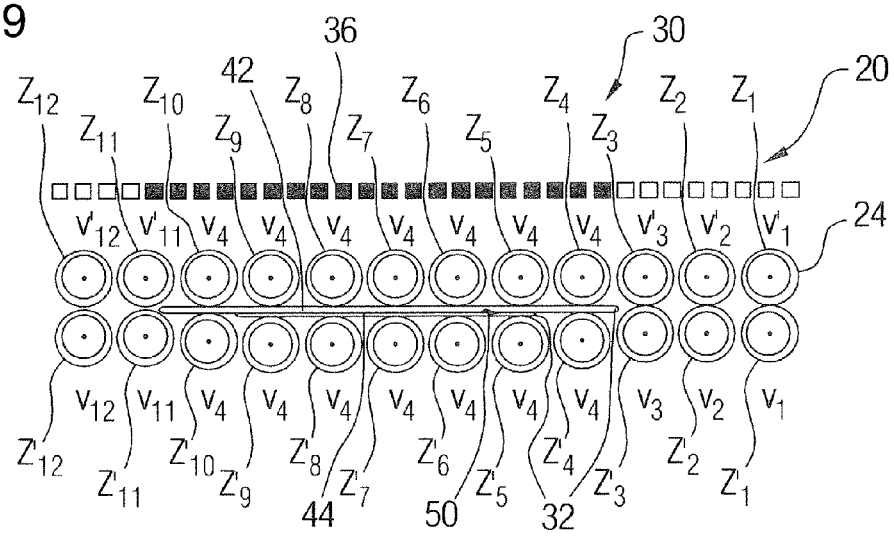

In the position of the postal items 42, 44 shown in FIG. 9, the process device is also unable to detect that there are two overlapping postal items 42, 44. However, in order to separate postal items 42, 44 which are entangled in such a way, at the time shown in FIG. 9 the process device 22 switches over the forward driving speeds $v_1$-$v_{12}$ and $v'_1$-$v'_{12}$ so that the top traction devices $Z_1$-$Z_{12}$ are now driven at the lower dashed forward driving speeds and the bottom traction devices $Z'_1$-

$Z'_{12}$ are driven at the higher un-dashed forward driving speeds. As a result, the bottom postal item 44 can be pushed forwards relative to the top postal item 42, enabling the entanglement 50 to be released.

Given the case that the leading edges 32 of the two postal items 42, 44 are at the same height—which although this is not the case in FIG. 9 must be considered here as a possibility—then the top postal item 42 would now be transported at the forward driving speed $v'_4$ applied by the traction device $Z_4$. The bottom postal item 44 would now be transported at the forward driving speed $v_4$, which is faster than the forward driving speed $v'_4$, enabling the entanglement 50 to be released. Because of the different transport speeds, the process device 22 would detect the presence of two overlapping postal items 42, 44.

However, in the exemplary embodiment shown in FIG. 9, the leading edge 32 of the bottom postal item 44 is pushed back slightly with respect to the leading edge 32 of the postal item 42. As a result, the forward driving speed $v_4$ of the traction device $Z'_4$ is applied to the postal item 42 and the forward driving speed $v_5$ of the fifth bottom traction device $Z'_5$ is applied to the bottom postal item 44. However, this would only be the case if $v_5>v_4$, which does not apply. Therefore, even switching over the dashed forward driving speeds to the un-dashed forward driving speeds and vice versa cannot solve this special case.

In addition to switching over the dashed speeds to the un-dashed speeds and vice versa, the process device 22 therefore briefly drives the bottom traction devices $Z'_4$-$Z'_{10}$ consecutively with a particularly fast forward driving speed $v_s$. In doing so, the traction device $Z'_4$ is initially driven at this high forward driving speed $v_s$ so that the whole package comprising the two postal items 42, 44 is transported at this high forward driving speed $v_s$. However, this step can be omitted, as it would only be effective if both postal items 42, 44 were clamped between the fourth pair of traction devices $Z_4$, $Z'_4$. In this case, switching over from the dashed to the un-dashed forward driving speeds and vice versa would be sufficient.

Figure 10:
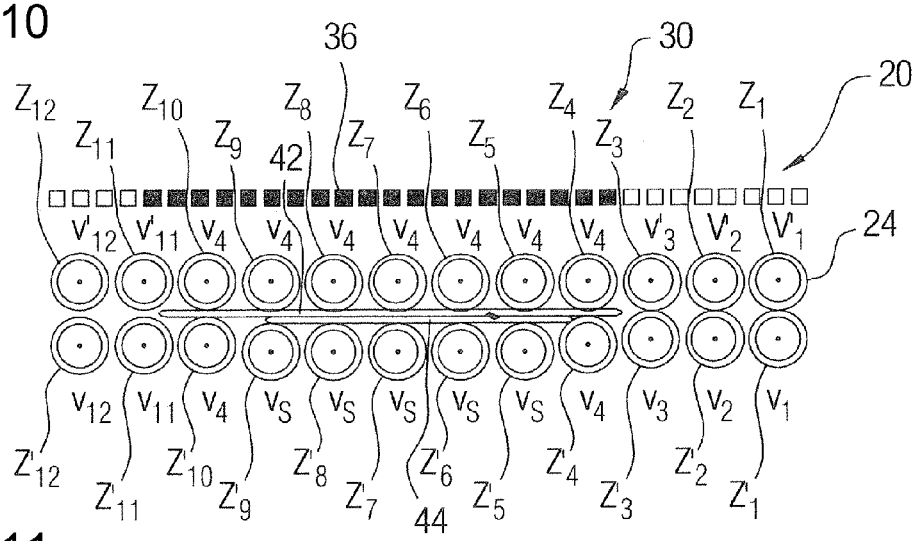

It is therefore possible to start by driving the next following traction device $Z'_5$ at the high forward driving speed $v_s$. This is greater than the forward driving speed $v_4$ so that the bottom postal item 44 is moved forwards relative to the top postal item 42 and, as a result, the entanglement 50 is released as shown in FIG. 10. The speed difference between the two postal items 42, 44 can be detected by the process device 22, and the top postal item 42 can be stopped and the bottom postal item 44 can be transported away.

To release the entanglement 50, it would likewise be conceivable to stop the top traction devices $Z_1$-$Z_{12}$ and to only drive the bottom traction devices $Z'_5$-$Z'_{10}$. This would also enable the presence of the two entangled postal items 42, 44 to be detected.

Figure 11:
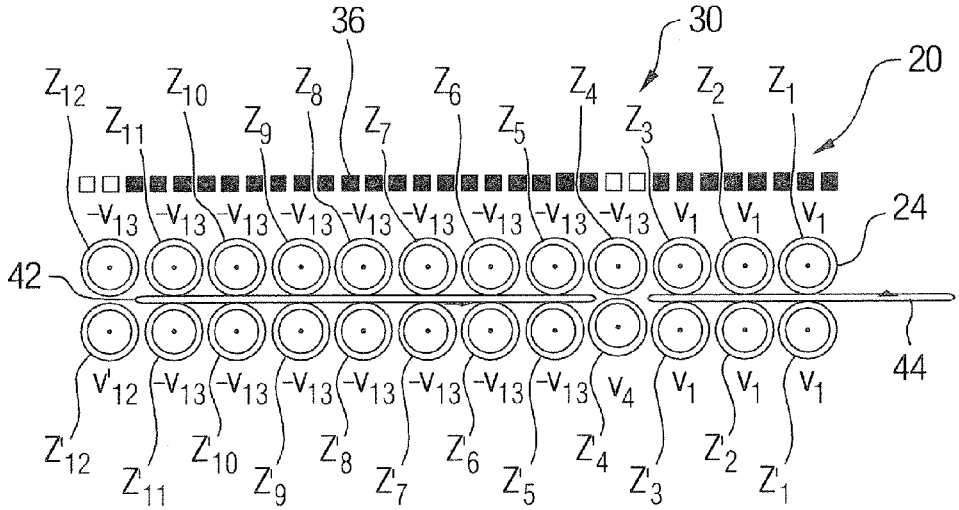

After the entangled bottom postal item 44 has been detected, this alone can be transported away forwards. To do this, the top postal item 42 can be stopped. However, the top postal item 42 is already so far forwards in the separating device 20 that if the bottom postal item 44 were transported away, it would no longer be possible to check whether a further postal item had been doubly removed with this postal item 44. The top postal item 42 is therefore reversed at a slow speed $-v_{13}$ as shown in FIG. 11. A reversal can also generally be initiated when it has been detected that several postal items need to be separated from one another. In this case, the process device 22 ensures that no gaps that have been formed are completely closed in order to avoid collisions from behind and therefore possible damage to the postal items.

The bottom postal item 44 is transported away forwards, wherein the shear effect due to the different forward driving speeds of the traction devices $Z_1$-$Z'_3$ described by way of example for FIG. 3 is applied to the postal item 44 so that a further possibly hidden postal item would be separated from it. When the postal item 42 is reversed, the top traction devices $Z_4$-$Z_{12}$ are driven at the slow reverse speed $v_{13}$ whereas a slow forward drive is applied to the bottom traction devices $Z'_4$-$Z'_{12}$. However, due to the freewheel function, in this case in the direction opposing the transport direction 12, the traction devices $Z'_5$-$Z'_{12}$ also reverse but exert a shear force on the postal item 42 so that any further postal item hidden behind it would be transported forwards and detected.

Figure 12:
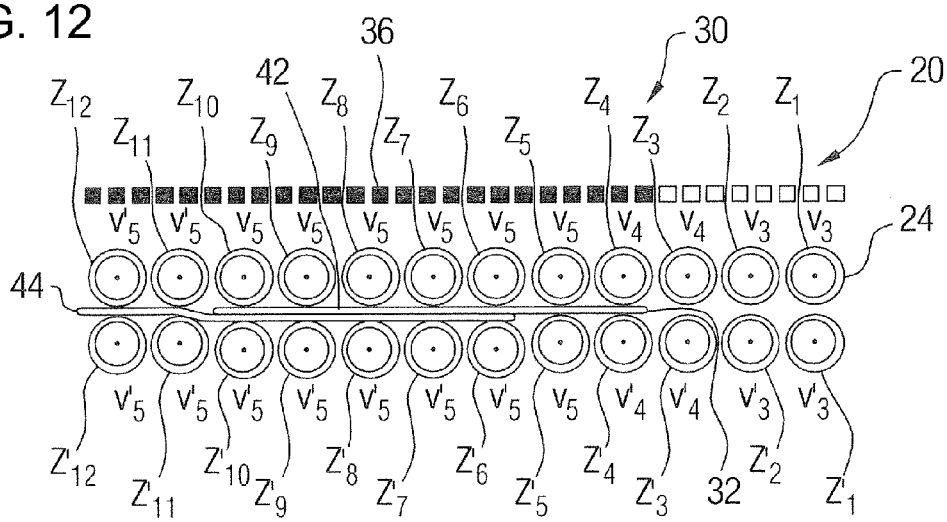
FIG. 12 shows the detection of slip of a postal item relative to the foremost transport device.

FIG. 12 shows a further exemplary embodiment initially starting from the exemplary embodiment in FIG. 2. Here, the top postal item 42 is so heavy or so smooth that it is not properly gripped by the two traction devices $Z_4$, $Z'_4$ but slips slightly between these two traction devices $Z_4$, $Z'_4$. As a result of this, the postal item 42 is not transported at the forward driving speed $v_4$, but only at the somewhat slower forward driving speed $v_5$ of the fifth top traction device $Z_5$.

In this situation, it is not possible to detect from the speeds of the top traction devices $Z_1$-$Z_{12}$ alone whether the postal item 42 has simply not been gripped correctly or whether a further postal item is located in the separating device 20 above and overlapping the postal item 42, so that the traction device $Z_4$ grips the postal item 42 and the traction device $Z_5$ grips the further overlapping postal item, which would then be transported away at the slower forward driving speed $v_5$.

However, the transport speed of the postal item 42 is monitored from the speed of movement of the leading edge 32 of the postal item 42 with the help of the sensor elements 36. From this, the process device 22 detects that the leading edge 32 is only moving forwards at the transport speed $v_5$ and the front part of the postal item 42 is therefore without doubt not properly gripped by the two traction devices $Z_4$, $Z'_4$.

In such a case, two traction devices on each side of the postal items 42, 44 can be switched to the same forward driving speed as shown by way of example in FIG. 12. In this case, as soon as the leading edge 32 moves between the two third traction devices $Z_3$, $Z'_3$, which are driven at the same forward driving speed as the fourth traction devices $Z_4$, $Z'_4$, the front postal item 42 should be transported at the forward driving speed $v_4$, as the forward drive at this speed is applied to the postal item 42 by two traction devices $Z_3$, $Z_4$.

It is now possible to proceed as described for FIG. 2 and FIG. 3, wherein however two traction devices $Z_1$ and $Z_2$, $Z'_1$ and $Z'_2$, $Z_3$ and $Z_4$, $Z'_3$ and $Z'_4$, etc. are switched together at all times as shown in FIG. 12. Of course, it is also possible to switch three or more traction devices together with the same forward driving speed at any one time. In this way, clarity can be gained over the arrangement of postal items 42, 44 in the separating device 20, and the postal items 42, 44 can be reliably separated from one another, even in the case of slipping postal items 42.

Figure 13:
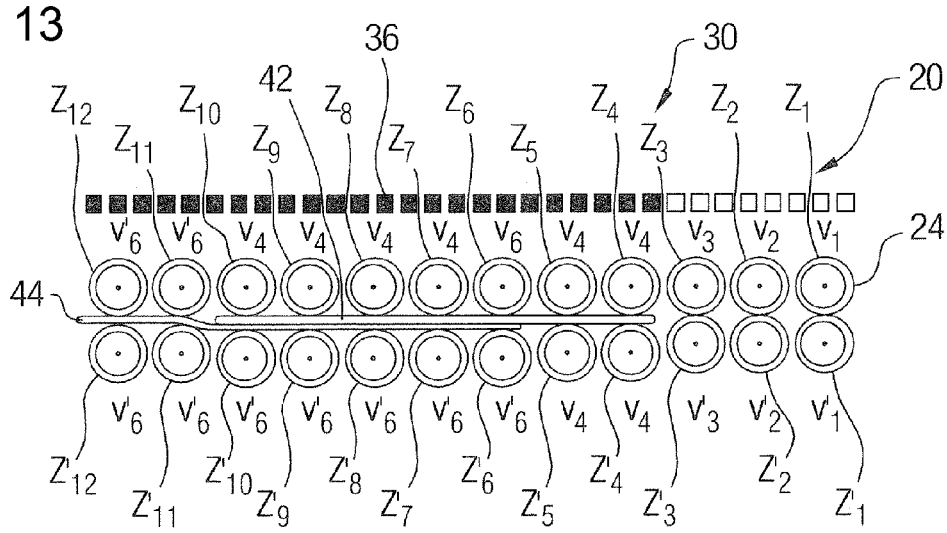
FIG. 13 shows a reinforced holding back of a postal item overlapping at the rear.

A method for checking whether a postal item 42 is correctly gripped by traction devices is shown in FIGS. 13-16. FIG. 13 shows a starting situation similar to FIG. 2. However, the forward driving speed of the sixth top traction device $Z_6$ is briefly switched over from the freewheeling speed $v_4$ to a lower forward driving speed $v_6$; the freewheeling of the sixth traction device $Z_6$ is therefore briefly removed. As a result, this traction device $Z_6$ applies a higher frictional torque and therefore a greater braking force to the postal item 42 than the traction devices $Z_5$-$Z_{10}$ when they are only freewheeling.

At the same time, the transport speed of this postal item 42 is measured, namely using the sensor elements 36 and additionally using the freewheeling traction elements $Z_5$, $Z_7$, $Z_8$, etc. If it is established that the postal item 42 is braking, then this is not yet gripped securely enough in the foremost pair of traction devices $Z_4$, $Z'_4$ and the increased braking torque of the traction device $Z_6$ is removed and reapplied after a specified waiting time for a further test on the postal item 42. If it is established that the postal item 42 continues to be transported at the correct forward driving speed, in the example of FIG. 13 at $v_4$, in spite of the increased braking torque, then further traction devices $Z_7$, $Z_8$, etc. and also the bottom traction devices $Z'_6$, $Z'_7$, $Z'_8$, etc. can be switched to a retaining mode by removing their freewheel effect and applying an increased braking torque to the overlapping postal item 44 and any existing postal items, and these can be reliably separated from the foremost postal item 42.

Figure 14:
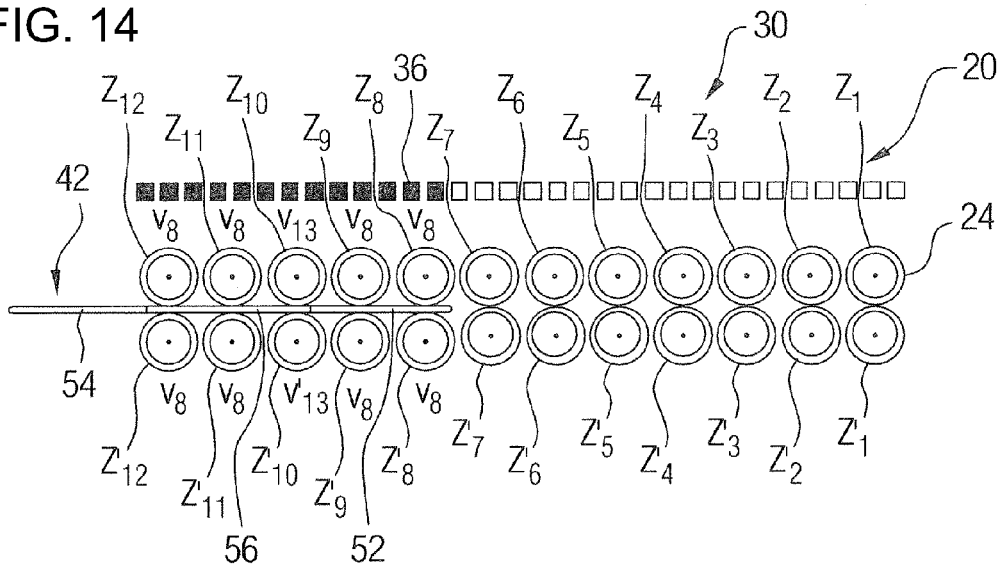
FIGS. 14 to 15 show the division of a postal item into three areas and the switching over of rear traction devices to a retaining mode.
Figure 15:
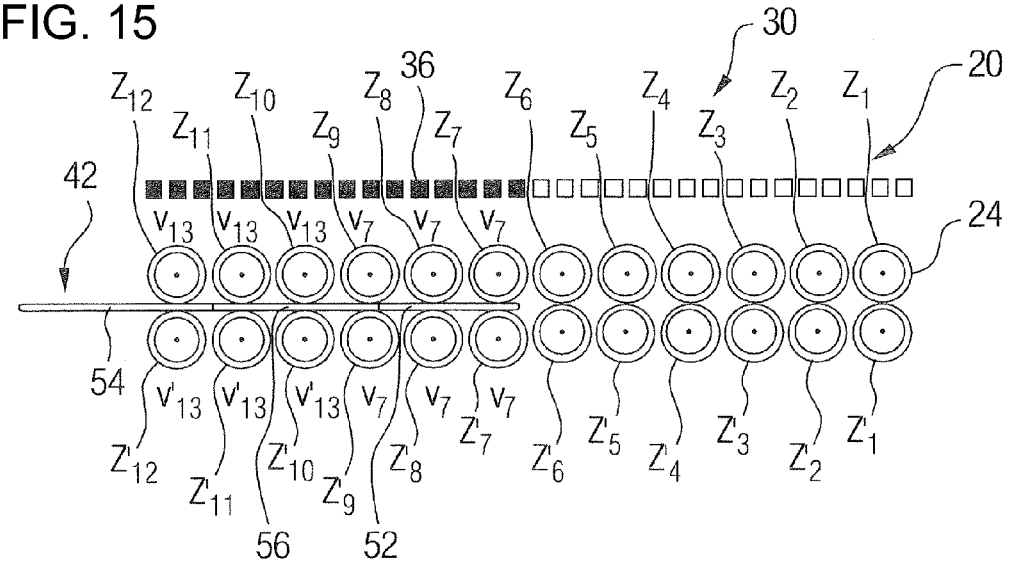

A more detailed exemplary embodiment of this method is shown in FIGS. 14 and 15. The length of the postal item 42 is first measured, for example using the sensor elements 36 or using the displacement sensors 40 or other sensors. The postal item 42 is then divided by the process device 22 into a front area 52 and a rear area 54 and optionally additionally into a central area 56. The postal item 42 is fed into the separating device 20, for example as described for FIG. 2, wherein as usual the un-dashed forward driving speeds are greater than the dashed forward driving speeds.

When the rear area 54 reaches a previously defined pair of traction devices, for example the traction devices $Z_{10}$, $Z'_{10}$, then this pair of traction devices—and if necessary additional pairs of traction devices located further back—are switched to retaining function, that is to say their freewheeling effect is removed and an increased retaining torque is applied to the postal item 42 to separate it from any further and overlapping postal items.

In the further and refined process with the optional central area 56, the process can be such that as soon as the central area 56 enters between the defined pair of traction devices, for example as shown in FIG. 14, only this pair of traction devices is switched to retaining mode. If the postal item 42 is braked, the retaining mode for this pair of traction devices is removed and the postal item 42 is transported further for a pre-determined time before starting a new retaining attempt with the defined pair of traction devices. If, in spite of the increased retaining torque of the defined pair of traction devices, the postal item 42 is transported unchanged or at the forward driving speed of the foremost traction device, in the example of FIG. 15 at the forward driving speed $v_7$, then the defined pair of traction devices, and if necessary the pair of traction devices behind them, are switched to a retaining mode as shown in FIG. 15. These pairs of traction devices now rub against the postal item 42 and reliably strip off any overlapping postal items.

Figure 16:
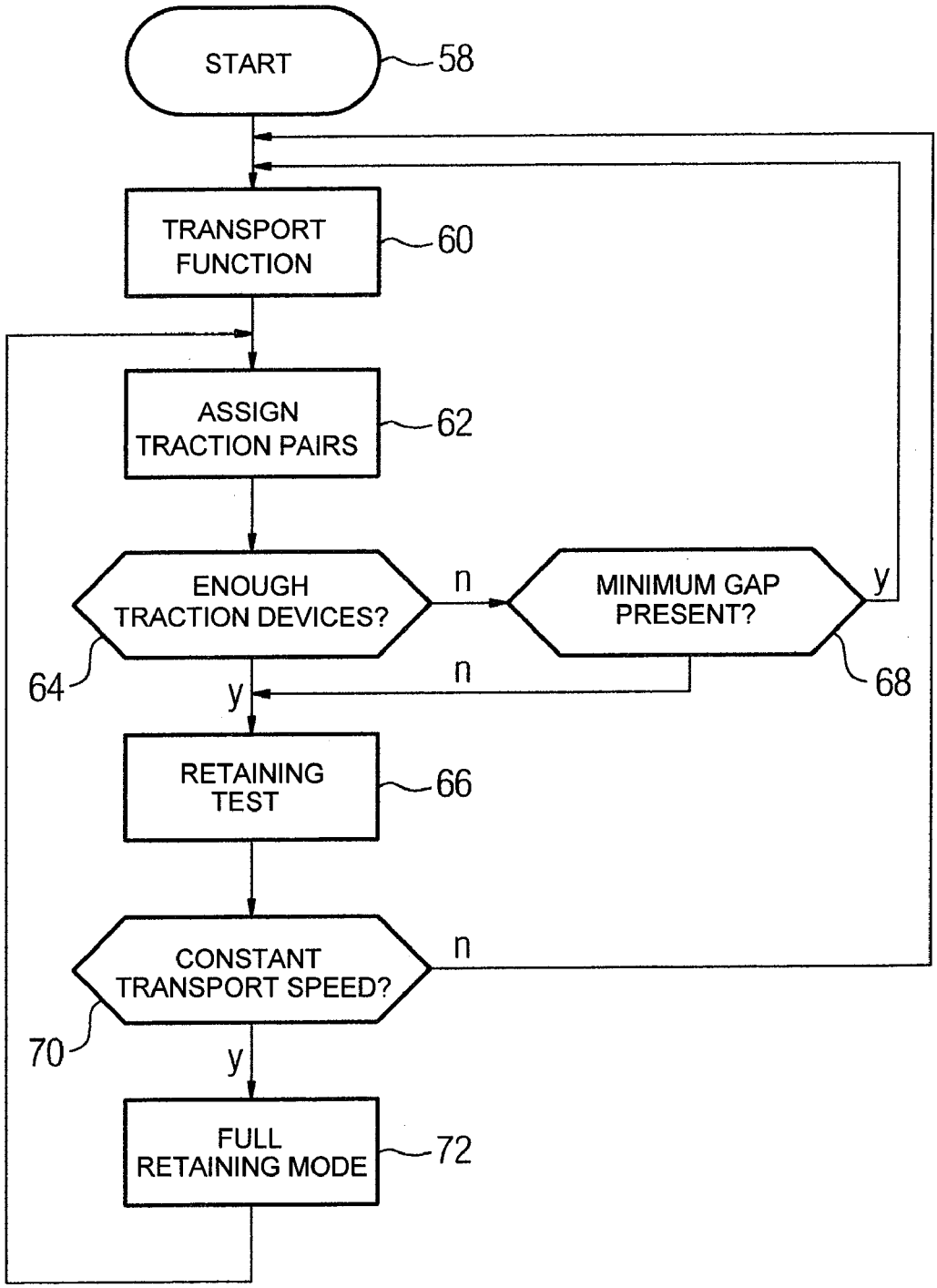
FIG. 16 shows a flow diagram of a method according to the invention for separating postal items.

A flow diagram of the method is shown in FIG. 16. After the start 58, the postal item 42 is transported into the separating device 20 in the transport function 60. In addition to the test method described above, a thickness of the postal items 42, 44 can be taken into account. As the thickness of the postal items 42, 44 usually corresponds to their weight and therefore to their inertia, a thicker postal item 42, 44 must be gripped more firmly than a thinner postal item 42, 44. However, the incorporation of the thickness described here can also be dispensed with, as the test method is already reliable on its own.

As an option, the thickness of the postal item 42 or of several postal items 42, 44 can be measured using the displacement of the bottom traction devices $Z'_1$-$Z'_{12}$ with the help of the sensors 40. An assignment 62 now takes place in the process device 22 based on a table in which a number of pairs of traction devices, between which the postal item 42 must be located, is assigned to the appropriate thickness of the postal item. The thicker the postal item 42, the more pairs of traction devices must have gripped the postal item 42 before a retaining mode can be activated. A possible example of the assignment is shown below:

| Thickness of postal item [mm] | Number of pairs of traction devices |
|---|---|
| <1 | 1 |
| 1 | 1 |
| 2 | 2 |
| 3 | 2 |
| 4 | 2 |
| 5 | 2 |
| 6 | 3 |
| 7 | 3 |
| 8 | 3 |
| 9 | 4 |
| 10 | 4 |
| >10 | 5 |

If the thickness of the postal item 42 is less than 1 mm, then it is sufficient for the postal item 42 to be gripped by one pair of traction devices downstream of the selected pair of traction devices which carries out a retaining function. In the example of FIG. 14, it is therefore sufficient if the postal item 42 were gripped by the two traction devices $Z_9$, $Z'_9$. If, in a different example, the thickness of the mailing is between 5 mm and 6 mm, then the postal item must be gripped by at least two downstream pairs of traction devices. With a mailing thickness of over 6 mm, the postal item 42 must be gripped by three pairs of traction devices in order to be reliably gripped.

When the thickness of the postal items 42, 44 has been checked, only then is the retaining mode switched on as a test and the selected pair of traction devices, in the example of FIG. 14 the traction devices $Z_{10}$ and $Z'_{10}$, switched to retaining mode. In the query step 64, it is established whether the postal item 42 has already been gripped by at least as many pairs of traction devices as have been assigned to the mailing thickness in the assignment 62. If this is the case, the retaining test 66 can be carried out.

If this is not the case, it is queried whether a gap before the postal item 42 has reached at least a minimum size. This query is necessary to provide a necessary spacing between the postal item 42 and a possibly preceding postal item so that at least a minimum gap is set between the postal items. If the minimum gap or a larger gap is present, then the postal item 42 can be transported onwards so that, after the appropriate query 68, a switchover to the transport function 60 occurs once more. If the minimum gap has not been achieved, then the postal item 42 must be braked in all cases and a switchover to the retaining test 66 occurs.

After a specified time from the start of the retaining test 66, it is determined in a query step 70 whether the transport speed of the postal item 42 is constant. If this is the case, then a switchover to the full retaining mode 72 can take place. The retaining mode 42 is retained for a specified time or retained until the postal item 42 has left the holding back pair of traction devices. If the mailing speed is not constant, that is to say the retaining test 66 is negative, then the method is fed back to the transport function 60 and the postal item 42 is transported onwards for a specified time.

In this way, an optimum changeover point at the start of the retaining mode can be determined without a rear area 54 of the postal item 42 having to have arrived at the specified pair of traction devices. The early changeover to retaining mode enables the whole separating device 20 to be kept short.

The invention claimed is:

1. A method for separating objects from a stack into a stream of objects, which comprises:

removing objects from the stack with a removal device;

separating overlapping objects from one another with a separating device;

gripping both sides of a removed object with a plurality of traction devices including forward traction devices gripping a forward part of the object and rearward traction devices gripping the object further back; and driving the traction devices in a transport direction at defined forward driving speeds, and thereby:

driving the forward traction devices at a faster forward driving speed than the rearward traction devices; and driving the traction devices on one side of the object at a higher forward driving speed than the respective traction devices on the opposite side.

2. The method according to claim 1, wherein the traction devices are each arranged opposite the object in pairs.

3. The method according to claim 1, wherein the transport speed increases from traction device to traction device in the transport path.

4. The method according to claim 1, which comprises gripping the front of the object with the forward traction devices with a higher frictional torque than with the traction devices which grip further back on the object.

5. The method according to claim 1, which comprises increasing the frictional torque in the transport path from traction device to traction device.

6. The method according to claim 1, wherein traction devices which grip the object freewheel and are pulled by the object.

7. The method according to claim 6, wherein traction devices which grip the object and are freewheeling exert a smaller force on the object than they exert on the object when they are driving.

8. The method according to claim 6, which comprises driving the traction devices which grip the object and are freewheeling at a forward driving speed.

9. The method according to claim 1, which comprises switching over a speed difference so that the traction devices on one side of the object are in each case driven slower than the respective opposing traction devices.

10. The method according to claim 1, which comprises measuring the running speed of the traction devices with speed sensors.

11. The method according to claim 1, which comprises detecting a leading edge and a trailing edge of an object in the separating device with a sensor.

12. The method according to claim 11, which comprises comparing a speed of the object determined by way of the sensor with a speed determined by speed sensors for measuring a speed of the traction devices.

13. An apparatus for separating objects from a stack in a stream of objects, comprising:

a removal device for removing the objects from the stack;

a separating device for separating overlapping objects from one another; and a process device connected to said separating device for controlling the separation;

said separating device having a plurality of traction devices on both sides of an object located in said separating device for jointly gripping the object, and said traction devices being driveable in the transport direction at mutually different forward driving speeds;

said process device being configured to drive traction devices that grip a front of the object in the transport direction at a faster forward driving speed than traction devices which grip further back on the object; and said process device being configured to drive said traction devices on one side of the object at a greater forward driving speed than the respective opposing traction devices in each case.

14. The apparatus according to claim 13, wherein each of said traction devices has a separate drive and each is driven individually by said process device.

* * * * *